US010611507B2

(12) United States Patent
Trombetta et al.

(10) Patent No.: US 10,611,507 B2
(45) Date of Patent: Apr. 7, 2020

(54) CAPSULE WITH CONTROL MEMBER

(71) Applicant: 2266170 Ontario Inc., Mississauga (CA)

(72) Inventors: Liberatore A. Trombetta, Ancaster (CA); YuCheng Fu, Mississauga (CA); Dennis Dwight Paynter, Grapevine, TX (US); Stephen Leung, Markham (CA)

(73) Assignee: 2266170 Ontario Inc., Mississauga, ON (CA)

( * ) Notice: Subject to any disclaimer, the term of this patent is extended or adjusted under 35 U.S.C. 154(b) by 174 days.

(21) Appl. No.: 14/463,770

(22) Filed: Aug. 20, 2014

(65) Prior Publication Data

US 2015/0056340 A1 Feb. 26, 2015

Related U.S. Application Data

(60) Provisional application No. 61/867,819, filed on Aug. 20, 2013.

(51) Int. Cl.

| | |
|---|---|
| ***B65B 29/02*** | (2006.01) |
| ***B65B 1/02*** | (2006.01) |
| ***B65B 3/02*** | (2006.01) |
| ***B65B 7/28*** | (2006.01) |
| ***B65B 29/06*** | (2006.01) |

(Continued)

(52) U.S. Cl.

CPC ..... *B65B 29/02* (2013.01); *B65B 1/02* (2013.01); *B65B 3/022* (2013.01); *B65B 3/10* (2013.01); *B65B 7/28* (2013.01); *B65B 7/2842* (2013.01); *B65B 7/2878* (2013.01); *B65B 29/06* (2013.01);

(Continued)

(58) Field of Classification Search

CPC ..... B65D 85/8043; B65D 85/804; B65D 85/8046; A25F 5/38; B65B 29/02; B65B 29/06; B65B 1/02; B65B 3/022; B65B 3/10; B65B 7/2878; B65B 7/28; B65B 7/2842; B65B 31/028

USPC ..... 426/77, 78, 79, 80, 81, 82, 83, 84, 595; 99/295

See application file for complete search history.

(56) References Cited

U.S. PATENT DOCUMENTS 1,951,357 A * 3/1934 Hall ..... 426/103
2,113,715 A 4/1938 Wilcox (Continued)

FOREIGN PATENT DOCUMENTS

CA 2012891 9/1991
CA 2276927 1/2000

(Continued)

OTHER PUBLICATIONS

International Search Report & Written Opinion in PCT/CA2014/050800 dated Nov. 21, 2014.

*Primary Examiner* — Ericson M Lachica
(74) *Attorney, Agent, or Firm* — Manelli Selter PLLC; Edward Stemberger

(57) ABSTRACT

A capsule is provided for use in a machine for preparing a consumable product from capsules. The capsule includes a body that defines an interior space with an opening. Ingredients are disposed within the interior space for preparing a desired product, a portion of the ingredients being non-permanently bound into a cluster. The cluster acts as a control member for controlling a flow of fluid for a period of time within the capsule. A cover is disposed over the opening.

23 Claims, 2 Drawing Sheets

Figure 1:
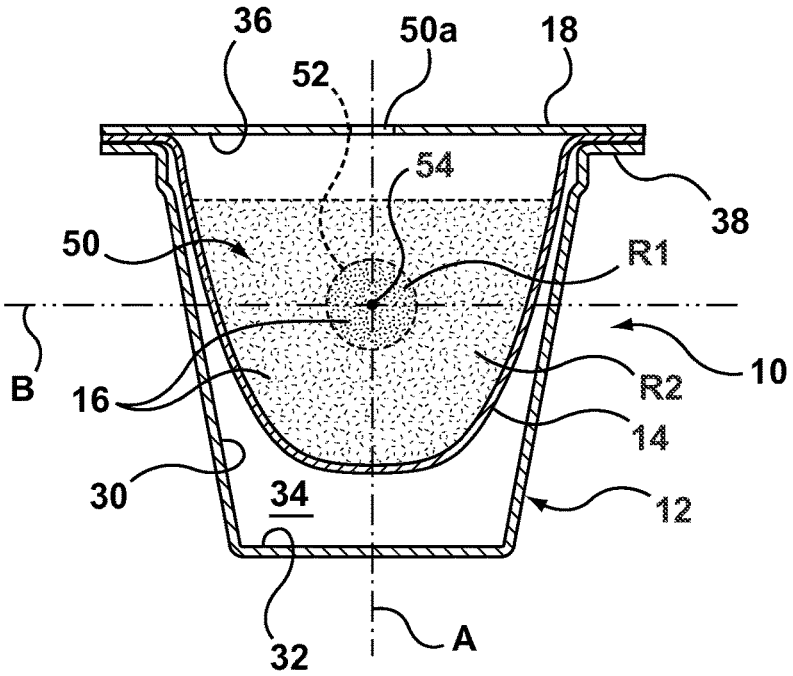
Figure 2A:
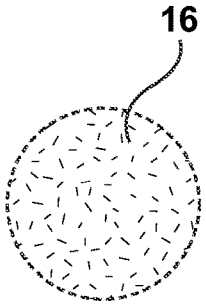
Figure 2B:
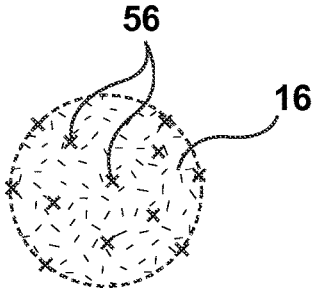
Figure 2C:
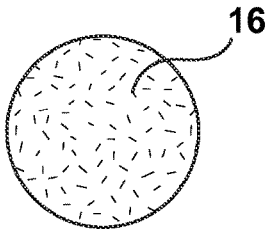
Figure 2D:
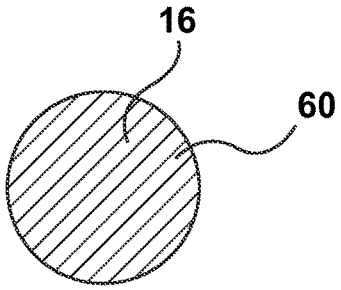

(51) Int. Cl.

| | |
|---|---|
| ***B65B 31/02*** | (2006.01) |
| ***B65D 85/80*** | (2006.01) |
| ***B65B 3/10*** | (2006.01) |
| ***B65D 85/804*** | (2006.01) |

(52) U.S. Cl.

CPC ..... *B65B 31/028* (2013.01); *B65D 85/8043* (2013.01)

(56) References Cited

U.S. PATENT DOCUMENTS 2,987,221 A 6/1961 Milton
3,110,121 A 11/1963 Corrinet
3,282,703 A 11/1966 Broadhurst
3,399,806 A 9/1968 Lucas
3,713,936 A 1/1973 Ramsay
4,101,627 A 7/1978 Menier
4,131,064 A 12/1978 Ryan et al.
4,220,673 A 9/1980 Strobel
4,235,160 A 11/1980 Olney et al.
4,306,367 A 12/1981 Otto
4,440,796 A 4/1984 Lunder et al.
4,471,689 A 9/1984 Piana
4,518,639 A 5/1985 Phillips
4,559,729 A 12/1985 White
4,619,830 A 10/1986 Napier
4,701,365 A 10/1987 Iwaski
4,728,425 A 3/1988 Sandvig
4,859,337 A 8/1989 Woltermann
4,865,737 A 9/1989 McMichael
4,867,993 A 9/1989 Nordskog
4,981,588 A 1/1991 Poulallion
4,983,410 A 1/1991 Dinos
4,995,310 A 2/1991 van der Lijn et al.
4,996,066 A 2/1991 Love et al.
5,008,013 A 4/1991 Favre et al.
5,076,433 A 12/1991 Howes
5,298,267 A 3/1994 Gruenbacher
5,331,793 A 7/1994 Pophal et al.
5,390,587 A 2/1995 Wu
5,447,631 A 9/1995 Mahlich
5,456,929 A 10/1995 Mifune et al.
5,496,573 A 3/1996 Tsuji et al.
5,536,290 A 7/1996 Stark et al.
5,575,383 A 11/1996 Seeley
5,601,716 A 2/1997 Heinrich et al.
5,605,710 A 2/1997 Prindonoff et al.
5,738,786 A 4/1998 Winnington-Ingram
5,806,582 A 9/1998 Howes
5,840,189 A 11/1998 Sylvan et al.
5,858,437 A 1/1999 Anson
5,866,185 A 2/1999 Burkett
5,871,096 A 2/1999 Yakich
5,871,644 A 2/1999 Simon et al.
5,882,716 A 3/1999 Munz-Schaerer et al.
5,885,314 A 3/1999 Oussoren et al.
5,895,672 A 4/1999 Cooper
5,896,686 A 4/1999 Howes
5,897,899 A 4/1999 Fond
5,923,242 A 7/1999 Slagle et al.
5,957,279 A 9/1999 Howes
5,971,195 A 10/1999 Reidinger et al.
6,025,000 A 2/2000 Fond et al.
6,146,270 A 11/2000 Huard et al.
6,189,438 B1 2/2001 Bielfeldt et al.
6,220,147 B1 4/2001 Priley
6,223,937 B1 5/2001 Schmidt
6,440,256 B1 8/2002 Gordon et al.
6,514,555 B1 2/2003 Fayard et al.
6,548,433 B1 4/2003 Gbur et al.
6,557,597 B2 5/2003 Riesterer
6,561,232 B1 5/2003 Frutin
6,589,577 B2 7/2003 Lazaris et al.
6,607,762 B2 8/2003 Lazaris et al.
6,622,615 B2 9/2003 Heczko
6,644,173 B2 11/2003 Lazaris et al.
6,645,537 B2 11/2003 Sweeney et al.
6,658,989 B2 12/2003 Sweeney et al.
6,720,070 B2 4/2004 Hamaguchi et al.
6,740,345 B2 * 5/2004 Cai ..... 426/77
6,758,130 B2 7/2004 Sargent et al.
6,810,788 B2 11/2004 Hale
6,841,185 B2 1/2005 Sargent et al.
6,854,378 B2 2/2005 Jarisch et al.
6,869,627 B2 3/2005 Perkovic et al.
6,913,777 B2 7/2005 Rebhorn et al.
6,959,832 B1 11/2005 Sawada
6,992,586 B2 1/2006 Rosenfeld
7,067,038 B2 6/2006 Trokhan et al.
7,153,530 B2 12/2006 Masek et al.
7,279,188 B2 10/2007 Arrick et al.
7,311,209 B2 12/2007 Bentz et al.
7,325,479 B2 2/2008 Laigneau et al.
7,328,651 B2 2/2008 Halliday et al.
7,387,063 B2 6/2008 Vu et al.
7,412,921 B2 8/2008 Hu et al.
7,444,925 B2 11/2008 Machlich
7,490,542 B2 2/2009 Macchi et al.
7,543,527 B2 6/2009 Schmed
7,552,672 B2 6/2009 Schmed
7,552,673 B2 6/2009 Levin
7,624,673 B2 6/2009 Zanetti
7,594,470 B2 9/2009 Scarchilli et al.
7,640,842 B2 1/2010 Bardazzi
7,681,492 B2 3/2010 Suggi et al.
7,685,930 B2 3/2010 Mandralis et al.
7,698,992 B2 4/2010 Wei
7,763,300 B2 7/2010 Sargent et al.
7,798,055 B2 9/2010 Mandralis et al.
7,854,192 B2 12/2010 Denisart et al.
7,856,920 B2 12/2010 Schmed et al.
7,856,921 B2 12/2010 Arrick et al.
7,910,145 B2 3/2011 Reati
8,062,682 B2 * 11/2011 Mandralis et al. ..... 426/119
8,225,771 B2 7/2012 Andre
8,286,547 B1 10/2012 Lassota
8,361,527 B2 1/2013 Winkler et al.
8,409,646 B2 4/2013 Yoakim et al.
8,425,957 B2 4/2013 Steenhof et al.
8,474,368 B2 7/2013 Kilber et al.
8,475,854 B2 7/2013 Skalski et al.
8,481,097 B2 7/2013 Skalski et al.
8,573,114 B2 11/2013 Huang et al.
8,591,978 B2 11/2013 Skalski et al.
8,673,379 B2 3/2014 Skalski et al.
8,740,020 B2 6/2014 Marina et al.
8,834,948 B2 9/2014 Estabrook et al.
8,960,078 B2 2/2015 Hristov et al.
2002/0020659 A1 2/2002 Sweeney et al.
2003/0005826 A1 1/2003 Sargent et al.
2003/0039731 A1 2/2003 Dalton et al.
2003/0087005 A1 5/2003 Baron
2005/0016383 A1 1/2005 Kirschner et al.
2005/0051478 A1 3/2005 Karanikos et al.
2005/0158426 A1 * 7/2005 Hu et al. ..... 426/77
2005/0287251 A1 12/2005 Lazaris et al.
2006/0236871 A1 10/2006 Ternite et al.
2006/0246187 A1 11/2006 Egolf et al.
2007/0144356 A1 6/2007 Rivera
2007/0148290 A1 6/2007 Ternite
2007/0275125 A1 11/2007 Catani
2008/0015098 A1 1/2008 Littlejohn et al.
2008/0142115 A1 6/2008 Vogt et al.
2008/0156196 A1 7/2008 Doglioni et al.
2008/0202075 A1 8/2008 Kronawittleithner et al.
2008/0245236 A1 10/2008 Ternite et al.
2009/0022855 A1 * 1/2009 Steenhof et al. ..... 426/78
2009/0110775 A1 4/2009 Rijskamp et al.
2009/0133584 A1 5/2009 De Graaff et al.
2009/0165228 A1 7/2009 Kilkenny
2009/0175986 A1 7/2009 Doglioni Majer
2009/0186141 A1 7/2009 Almblad et al.
2009/0206084 A1 8/2009 Woolf et al.
2009/0211458 A1 8/2009 Denisart et al.

(56) References Cited

U.S. PATENT DOCUMENTS

| | | | | |
|---|---|---|---|---|
| 2009/0260690 | A1 | 10/2009 | Bell | |
| 2009/0311389 | A1 | 12/2009 | Zoss et al. | |
| 2009/0324791 | A1 | 12/2009 | Ohresser et al. | |
| 2010/0003379 | A1 | 1/2010 | Zoss et al. | |
| 2010/0028495 | A1 | 2/2010 | Novak et al. | |
| 2010/0116772 | A1 | 5/2010 | Teys | |
| 2010/0215808 | A1 | 8/2010 | Versini | |
| 2010/0239733 | A1 | 9/2010 | Yoakim et al. | |
| 2010/0303964 | A1 | 12/2010 | Beaulieu et al. | |
| 2011/0003040 | A1 | 1/2011 | Graf et al. | |
| 2011/0033580 | A1 | 2/2011 | Bieshuevel et al. | |
| 2011/0041469 | A1 | 2/2011 | Hale | |
| 2011/0045144 | A1 | 2/2011 | Boussemart et al. | |
| 2011/0076361 | A1 | 3/2011 | Peterson et al. | |
| 2011/0183048 | A1 | 7/2011 | Noble et al. | |
| 2011/0185911 | A1 | 8/2011 | Rapparini | |
| 2011/0247975 | A1 | 10/2011 | Rapparini | |
| 2012/0006205 | A1 | 1/2012 | Vanni | |
| 2012/0024160 | A1 | 2/2012 | Van et al. | |
| 2012/0052163 | A1 | 3/2012 | Doleac et al. | |
| 2012/0070542 | A1* | 3/2012 | Camera et al. | 426/77 |
| 2012/0097602 | A1 | 4/2012 | Tedford | |
| 2012/0100264 | A1 | 4/2012 | Bucher et al. | |
| 2012/0114825 | A1* | 5/2012 | Imison | A23P 1/06 426/564 |
| 2012/0121764 | A1 | 5/2012 | Lai et al. | |
| 2012/0171334 | A1 | 7/2012 | Yoakim | |
| 2012/0174794 | A1 | 7/2012 | Fraij | |
| 2012/0180670 | A1 | 7/2012 | Yoakim | |
| 2012/0180671 | A1 | 7/2012 | Baudet | |
| 2012/0183649 | A1 | 7/2012 | Burkhalter | |
| 2012/0186457 | A1 | 7/2012 | Ozanne | |
| 2012/0196008 | A1 | 8/2012 | York | |
| 2012/0199007 | A1 | 8/2012 | Larzul | |
| 2012/0199010 | A1 | 8/2012 | Mariller | |
| 2012/0199011 | A1 | 8/2012 | Cheng | |
| 2012/0201933 | A1 | 8/2012 | Dran et al. | |
| 2012/0207893 | A1 | 8/2012 | Kreuger | |
| 2012/0207894 | A1 | 8/2012 | Webster | |
| 2012/0210876 | A1 | 8/2012 | Glucksman | |
| 2012/0210878 | A1 | 8/2012 | Mariller | |
| 2012/0210879 | A1 | 8/2012 | Mariller | |
| 2012/0231123 | A1 | 9/2012 | Kamerbeek | |
| 2012/0231124 | A1 | 9/2012 | Kamerbeek | |
| 2012/0231126 | A1 | 9/2012 | Lo Faro | |
| 2012/0231133 | A1 | 9/2012 | Kamerbeek | |
| 2012/0251668 | A1 | 10/2012 | Wong | |
| 2012/0251669 | A1 | 10/2012 | Kamerbeek | |
| 2012/0251670 | A1 | 10/2012 | Kamerbeek | |
| 2012/0251671 | A1 | 10/2012 | Kamerbeek | |
| 2012/0251692 | A1 | 10/2012 | Kamerbeek | |
| 2012/0251693 | A1 | 10/2012 | Kamerbeek | |
| 2012/0251694 | A1 | 10/2012 | Kamerbeek | |
| 2012/0258204 | A1 | 10/2012 | Tsuji | |
| 2012/0258210 | A1 | 10/2012 | Wong | |
| 2012/0258219 | A1 | 10/2012 | Wong | |
| 2012/0258221 | A1 | 10/2012 | Wong | |
| 2012/0260806 | A1 | 10/2012 | Rolfes | |
| 2012/0263829 | A1 | 10/2012 | Kamerbeek | |
| 2012/0263830 | A1 | 10/2012 | Kamerbeek | |
| 2012/0263833 | A1 | 10/2012 | Wong | |
| 2012/0266755 | A1 | 10/2012 | Baudet | |
| 2012/0269933 | A1 | 10/2012 | Rapparini | |
| 2012/0272830 | A1 | 11/2012 | Gugerli | |
| 2012/0276252 | A1 | 11/2012 | Bunke | |
| 2012/0276255 | A1 | 11/2012 | Verbeek | |
| 2012/0297987 | A1 | 11/2012 | Lee | |
| 2012/0301581 | A1 | 11/2012 | Abegglen | |
| 2012/0307024 | A1 | 12/2012 | Howes | |
| 2012/0308688 | A1 | 12/2012 | Peterson | |
| 2012/0312174 | A1 | 12/2012 | Lambert | |
| 2012/0321755 | A1 | 12/2012 | Macaulay | |
| 2012/0321756 | A1 | 12/2012 | Estabrook et al. | |
| 2012/0328739 | A1 | 12/2012 | Nocera | |
| 2012/0328740 | A1 | 12/2012 | Nocera | |
| 2012/0328744 | A1 | 12/2012 | Nocera | |
| 2013/0004629 | A1 | 1/2013 | Clark | |
| 2013/0004637 | A1 | 1/2013 | Gugerli | |
| 2013/0008316 | A1 | 1/2013 | Hoeglauer | |
| 2013/0011521 | A1 | 1/2013 | Weijers et al. | |
| 2013/0017303 | A1 | 1/2013 | Vu | |
| 2013/0025466 | A1 | 1/2013 | Fu | |
| 2013/0032034 | A1 | 2/2013 | Jarisch | |
| 2013/0047863 | A1 | 2/2013 | Larzul | |
| 2013/0059039 | A1 | 3/2013 | Trombetta | |
| 2013/0059903 | A1 | 3/2013 | Deuber | |
| 2013/0068109 | A1 | 3/2013 | Pribus et al. | |
| 2013/0084368 | A1 | 4/2013 | Linck et al. | |
| 2013/0095219 | A1 | 4/2013 | de Graaff et al. | |
| 2013/0115342 | A1 | 5/2013 | Van et al. | |
| 2013/0122153 | A1 | 5/2013 | Ferrier et al. | |
| 2013/0122167 | A1 | 5/2013 | Winkler et al. | |
| 2013/0142931 | A1 | 6/2013 | Fin et al. | |
| 2013/0259982 | A1 | 10/2013 | Abegglen et al. | |
| 2013/0340626 | A1 | 12/2013 | Oh | |
| 2013/0344205 | A1 | 12/2013 | Oh | |
| 2014/0013958 | A1 | 1/2014 | Krasne et al. | |
| 2014/0037802 | A1 | 2/2014 | Cardoso | |
| 2014/0099388 | A1 | 4/2014 | Wang et al. | |
| 2014/0106036 | A1* | 4/2014 | Cardoso | 426/115 |
| 2015/0050391 | A1 | 2/2015 | Rapparini | |

FOREIGN PATENT DOCUMENTS

| | | | |
|---|---|---|---|
| CA | 2517840 | | 4/2004 |
| CA | 2516417 | A1 | 9/2004 |
| CA | 2689804 | A1 | 3/2008 |
| CA | 2686347 | A1 | 12/2008 |
| CA | 2807489 | | 2/2012 |
| CA | 2824199 | A1 | 8/2012 |
| CA | 2759782 | A1 | 11/2012 |
| CA | 2801236 | A1 | 3/2013 |
| CN | 202537195 | | 11/2012 |
| CN | 202960136 | | 6/2013 |
| EP | 0047169 | A2 | 3/1982 |
| EP | 0145499 | | 6/1985 |
| EP | 0432126 | A1 | 6/1991 |
| EP | 1593329 | | 11/2005 |
| EP | 1859683 | | 11/2007 |
| EP | 2230195 | | 9/2010 |
| EP | 2345351 | | 7/2011 |
| EP | 2409608 | | 1/2012 |
| EP | 1208782 | | 8/2014 |
| FR | 2930522 | A1 | 10/2009 |
| GB | 803486 | A | 10/1958 |
| GB | 962038 | | 6/1964 |
| GB | 2074838 | | 11/1981 |
| JP | 662737 | | 3/1994 |
| JP | 11171249 | A | 6/1999 |
| KR | 20140031693 | | 3/2014 |
| WO | 9212660 | | 8/1992 |
| WO | 0145616 | A1 | 6/2001 |
| WO | 03082065 | A1 | 10/2003 |
| WO | 2004083071 | A1 | 9/2004 |
| WO | 2009114119 | | 9/2009 |
| WO | 2010013146 | A2 | 2/2010 |
| WO | 2010066705 | | 6/2010 |
| WO | 2010085824 | | 8/2010 |
| WO | 2011095518 | | 8/2010 |
| WO | 201006516 | A1 | 9/2010 |
| WO | 2010137956 | A1 | 12/2010 |
| WO | 2012031106 | A1 | 3/2012 |
| WO | 2012069505 | | 5/2012 |
| WO | 2014056862 | | 4/2014 |
| WO | 2014112556 | | 12/2014 |

* cited by examiner

CAPSULE WITH CONTROL MEMBER

FIELD

This specification relates to consumable products and in particular to capsules, for use in capsule machines, for preparing a consumable product.

BACKGROUND

The following background discussion is not an admission that anything discussed below is citable as prior art or common general knowledge. The documents listed below are incorporated herein in their entirety by this reference to them.

Single serve capsules for use in machines to prepare a desired consumable product are becoming increasingly popular. Such capsules come in a variety of formats containing ingredients for producing beverages such as coffee, tea, hot chocolate or soup broth.

Capsule machines typically include an injection system for injecting a fluid, such as hot water, into a capsule for mixing with ingredients disposed within the capsule to prepare a desired consumable product. A dispensing system may also be provided to dispense the prepared product from the capsule for delivery to a receptacle such as a user's cup or bowl.

A problem with conventional capsules is that it can be difficult to control the manner in which ingredients are exposed to fluid that is injected into the capsule. It may be desirable for example for certain ingredients to be mixed with fluid within the capsule for a longer period of time than other ingredients. It may also be desirable for certain ingredients to be separated from other ingredients within the capsule prior to, or for a desired period following, injection of fluid into the capsule.

Another problem with conventional capsules is that the fluid injected into the capsule may form one or more channels through the ingredients contained within the capsule along one or more axes of injection. This can result in fluid being dispensed from the capsule prior to adequately mixing with ingredients. Furthermore, some ingredients may not be sufficiently saturated with fluid to optimize the preparation of the desired product.

It is known to provide permanent structural elements within a capsule to manage the flow of fluid that is injected into the capsule. A problem with permanent structural elements is that they add to the cost and complexity of manufacturing the capsule. Permanent structural elements may also occupy space within the capsule which may be better utilized for other purposes.

There is a need for an improved capsule for use in a capsule machine.

SUMMARY

In one aspect the invention provides a capsule, for use in a machine for preparing consumable products from capsules, said capsule comprising:

a body defining an interior space with an opening;

ingredients disposed in said interior space for preparing a desired consumable product, a portion of said ingredients being non-permanently bound into a cluster; and a cover disposed over said opening.

In another aspect, the invention provides a capsule, for use in a machine for preparing consumable products from capsules, said capsule comprising:

a body defining an interior space with an opening;

ingredients disposed in said interior space for preparing a consumable product, a portion of said ingredients forming a control member for controlling a flow of fluid for a period of time within said capsule; and a cover disposed over said opening.

Other aspects and features of the teachings disclosed herein will become apparent, to those ordinarily skilled in the art, upon review of the following description of the specific examples of the specification.

DRAWINGS

The drawings included herewith are for illustrating various examples of articles, methods, and apparatuses of the present specification and are not intended to limit the scope of what is taught in any way. For simplicity and clarity of illustration, where considered appropriate, reference numerals may be repeated among the drawings to indicate corresponding or analogous elements.

Figure 3:
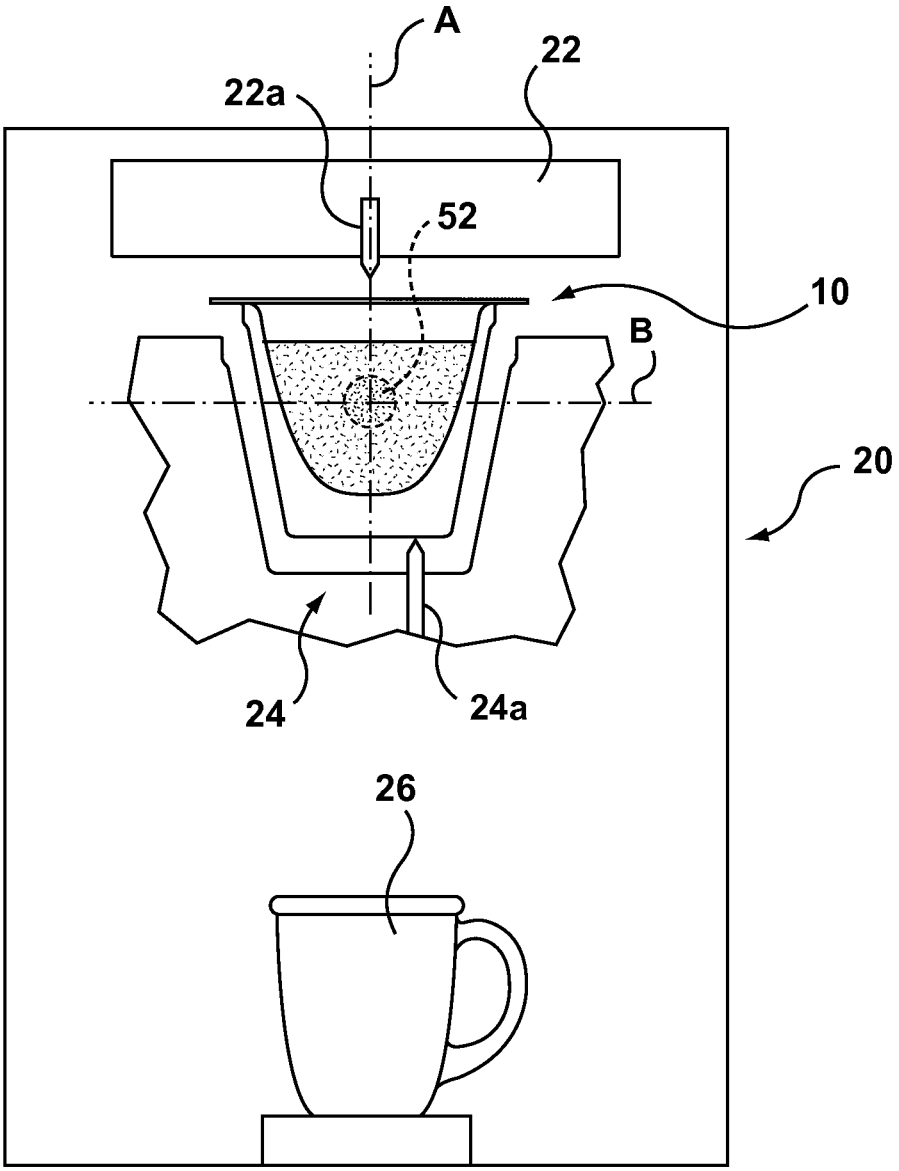

FIG. 1 is a sectional view of a capsule in accordance with the present invention;

FIGS. 2(*a*)-2(*d*) are schematic views of clusters defining control members for a capsule in accordance with the present invention; and FIG. 3 is a schematic view of a capsule machine for use with a capsule in accordance with the present invention.

DESCRIPTION OF VARIOUS EMBODIMENTS

Various apparatuses or methods will be described below to provide examples of the claimed invention. The claimed invention is not limited to apparatuses or methods having all of the features of any one apparatus or method described below or to features common to multiple or all of the apparatuses described below. The claimed invention may reside in a combination or sub-combination of the apparatus elements or method steps described below. It is possible that an apparatus or method described below is not an example of the claimed invention. The applicant(s), inventor(s) and/or owner(s) reserve all rights in any invention disclosed in an apparatus or method described below that is not claimed in this document and do not abandon, disclaim or dedicate to the public any such invention by its disclosure in this document.

A capsule in accordance with the present invention is shown generally at 10 in the figures. Capsule 10 includes a body 12, filter 14 (when required), ingredients 16 and cover 18. Capsule may be sized to provide a single serving of a desired product or multiple servings.

Ingredients 16 include soluble and/or insoluble ingredients that are a precursor to forming a desired product. Preferably, ingredients 16 are provided in a dry state. Soluble ingredients may include instant coffee, chocolate, soup stock or other ingredients in powdered, crystallized or other forms adapted for solubility or contained within a soluble film or pouch. Insoluble ingredients may include tea leaves, coffee grounds, herbs or other ingredients adapted for forming a consumable product by extraction or infusion. Ingredients 16 may also include active ingredients (eg foaming agents), natural health additives, regulated drugs, alcohol or other soluble or insoluble ingredients.

Ingredients 16 may be disposed in a plurality of distinct regions R1, R2 . . . Rn within capsule 10. The same type of ingredients 16 may be disposed in each region R or different types of ingredients 16 may be disposed in different regions R. The density, cohesion or other physical properties of ingredients 16 may also vary between regions R.

Capsule 10 is sized and configured for use in a machine 20 that is adapted for preparing a product from capsule 10. Machine 20 may include an injection system 22 for injecting a fluid, typically heated water, into the capsule for mixing with ingredients 16. Injection system 22 may include a nozzle 22*a* disposed on machine 20 that is adapted to pierce cover 18 to inject fluid into capsule 10. Injection system 22 may alternatively have at least one component disposed on capsule 10, such as on cover 18, and adapted to pierce body 12 and interact with machine 20 to inject fluid into capsule 10.

Machine may also include a dispensing system 24 for dispensing product from capsule 10 into a desired receptacle 26 such as a bowl or cup. Dispensing system 24 may include a hollow probe 24*a* that is adapted to pierce capsule 10 to dispense a prepared product from capsule 10.

Body 12 of capsule 10 includes a sidewall 30 and an end wall 32 together defining an interior space 34. An opening 36 is defined at one end of body 12 and a flange 38 extends around the perimeter of opening 36 to receive cover 18 and to support capsule 10 within machine 20.

In another embodiment, body 12 may be formed with no end wall 32 and no sidewall 30 or a partial sidewall 30. Flange 38 may still extend around the perimeter of opening 36 to receive cover 18 and to support capsule 10 within machine 20. Filter 14 may be secured to flange 38 or to partial sidewall 30.

Filter 14 is adapted to be disposed within body 12 to define at least one ingredients chamber for receiving one or more ingredients 16 and in particular insoluble ingredients 16 that are not intended to be dispensed into receptacle 26 (for example coffee grounds or tea leaves).

Filter 14 is preferably adapted to be phobic to the fluid being injected into capsule 10. In most instances, the fluid will comprise water (either heated or cooled) and a hydrophobic filter 14 is desired. Filter 14 may be formed of materials that are phobic to fluid such as polyolefins (eg, polyethylene, polypropylene) and mixtures of polyolefins with other polymers or filter 14 may be coated with materials that are phobic to fluid such as a polyethylene coating.

Preferably, filter 14 is formed of a moldable non-woven filtration material that includes a plurality of multi-component fibers that are bound or interlocked by non-woven manufacturing techniques (such as spun bond techniques) to form a web having channels extending from one side of filter 14 to the other. The desired diameter for channels after forming is between 20 and 100 μm, more preferably between 40 to 80 μm. More details of a preferred filtration material for filter 14 are provided in US patent publication 20140127364 which is hereby incorporated in its entirety herein by reference.

Filter 14 may be secured to flange 38 or to an interior surface of capsule 10 (such as to sidewall 30). Capsule 10 may be provided without filter 14 in instances where ingredients are soluble or where it is desired that insoluble ingredients 16 are dispensed together with fluid into receptacle 26 (this requires that dispensing system be adapted to dispense insoluble ingredients 16).

Cover 18 is disposed over opening 36 and secured to body 12 such as by sealing cover 18 directly to flange 38 or indirectly with a portion of filter 14 located between.

A control member 50 may be defined by a cluster 52 of ingredients 16 disposed within capsule 10 as described further below. Control member 50 may comprise a first region R1 of ingredients 16 within capsule 10. The remainder of ingredients 16 for capsule 10 may comprise a second region R2 or capsule 10. Second region R2 may partially or fully surround first region R1. Ingredients 16 in second region R2 may be loosely disposed within capsule while ingredients in first region R1 are contained within cluster 52.

Control member 50 is disposed at a location 54 within capsule 10 that is adapted for controlling the flow of fluid injected into capsule 10. Such fluid control may comprise dispersing a flow of fluid for a period of time, absorbing a flow of fluid for a period of time or otherwise controlling or altering the flow of fluid within capsule 10. Control member 50 comprises a non-permanent structure that is adapted to at least partially dissolve or break apart within capsule when exposed to a flow of fluid over a set period of time (such as the period of time required to inject the desired amount of fluid into capsule 10).

Location 54 is selected according to the type of capsule machine 20 and injection system 22 for which capsule 10 is intended to be used as well as the type of ingredients 16 disposed within capsule 10. Location 54 for K-cup™ brewers for example may be along a central axis A of capsule 10 in line with the flow of fluid that is injected into capsule 10 through injection nozzle 22*a*. Location 54 may also be along a transverse axis B where cluster 52 is formed as a layer or crust. In some instances it may be desirable for location 54 to be at a lower portion of capsule 10 and in other instances in may be preferable for location 54 to be at an upper location of capsule.

Cluster 52 comprises a portion of ingredients 16 that are non permanently bound together on their own or with the addition of a binder material. Cluster 52 is adapted to at least partially break apart or dissolve over a desired dwell time T within capsule, when exposed to the flow of fluid in a desired manner from a desired injection system 22.

Cluster 52 may be formed by compressing a portion of ingredients 16 by a desired amount as depicted in FIG. 2(*a*). The compression can be achieved by a compacting device or an auger system with a relatively high taper which delivers a compacted power to a container. The compression may occur during the process of filling capsule with ingredients or it may occur at a prior stage to filling capsule. Cluster 52 of compressed ingredients is adapted to dissolve or break apart over a period of time when exposed to a flow of fluid within capsule. A cluster 52 of compressed ingredients 16 allows a greater amount of ingredients 16 to be disposed within the same space within capsule 10. Cluster 52 (or region R1) has a higher density of ingredients 16 than ingredients disposed outside of cluster 52 in region R2.

Alternatively, cluster 52 may be formed with a desired binder material 56 as depicted in FIG. 2(*b*). Binder material 56 is preferably in a liquid state. For example, binder material 56 may be a neutral binder material or it may be an active binder material. A neutral binder material does not add any noticeable flavor, odour, sensory, health benefit or function to the consumable product produced from capsule 10 but may combine or agglomerate with a portion of ingredients 16 to form cluster 52. Examples of neutral binder materials include polyethylene glycol, polypropylene glycol, ethyl alcohol etc. An active binder material provides flavor, odour, sensory, health benefit or function to the consumable product and also may combine or agglomerate with a portion of ingredients 16 to form cluster 52. Examples of an active binder material include Ethyl-2-methybutyrate (apple), 1-octen-3-ol, (mushroom), p-menthene-8-thiol (Grapefruit), 5-methyl-2-hepten-4-one (Hazelnut). The active binder is employed either directly at a high concentration or diluted with a neutral material. Both neutral and active binder materials are preferably highly water soluble.

Alternatively, cluster 52 may be formed with a soluble container 58 that is adapted to contain the portion of ingredients 16 as depicted in FIG. 2(*c*). For example, soluble container 58 may be formed of soluble gels or films, preferably with water-soluble film. The portion of ingredients 16 contained within soluble container 58 may include liquid ingredients (such as a concentrate) or other ingredients that must be kept separated within capsule (such as foaming agents or other active ingredients).

Preferred materials for soluble container 58 include protein or carbohydrate based materials which could be starch based (e.g., amylose film and amylopectin film), protein based (e.g., gelatin film, casein film), polysaccharide based (e.g., pullulan film, cellulose film), alginate sodium film and pectin film, to name a few. For example, the Vivos™ edible water soluble film from MonoSol can be employed as a soluble container 58 for ingredients 16. The dissolution rate of soluble container 58, and thus cluster 52, is dependent on the material type. Within the same type, the dissolution rate is normally slower when having heavier material density or molecular weight. Preferably the film thickness for soluble container 58 is in the range of 10-100 μm, more preferably 20-80 μm and most preferably 30-70 μm.

Alternatively, cluster 52 may be provided as a tablet 60 as illustrated in FIG. 2(*d*). Tablet 60 may contain active or functional ingredients, which can be separated from the rest of ingredients. For instance, a food flavor in a tablet format can be used in this application to add certain flavor into food product.

Control member 50 is sized to control at least a portion of the flow of fluid injected into capsule 10 to other locations within the capsule. Preferably, for a single serve capsule, a single control member 50 has a width in the range of 1 to 25 millimeters and more preferably in the range of 5 to 15 millimeters. Multiple control members 50 comprising one or more types of clusters 52 may be disposed within capsule 10, in which case each control member 50 may have a smaller size.

While the above description provides examples of one or more processes or apparatuses, it will be appreciated that other processes or apparatuses may be within the scope of the accompanying claims.

We claim:

1. A capsule, for use in a machine that is adapted for injecting a fluid into a capsule for preparing a consumable product, said capsule comprising:

a body defining an interior space with an opening;

a filter disposed in said interior space to define an ingredients chamber;

an axis defined through said opening and said ingredients chamber in said body for receiving an injection of fluid from the machine;

insoluble ingredients disposed in said ingredients chamber for preparing a desired consumable product by extraction or infusion from the injection of fluid from the machine, a portion of said insoluble ingredients being non-permanently bound into a cluster that is disposed on the line of said axis; and a cover disposed over said opening.

2. The capsule of claim 1, wherein said cluster comprises compressed ingredients.

3. The capsule of claim 1, wherein said cluster includes a binder material that is adapted to bind said portion of ingredients together.

4. The capsule of claim 3 wherein said ingredients are provided in a dry state and said binder material is provided in a liquid state.

5. The capsule of claim 1, wherein said cluster includes a soluble container that is adapted to contain a portion of ingredients.

6. The capsule of claim 1 wherein said cluster includes a tablet that is adapted to contain a portion of ingredients.

7. The capsule of claim 1, wherein said cluster comprises a first region within said ingredients chamber and at least a portion of the remainder of said ingredients comprises a second region within said ingredients chamber.

8. The capsule of claim 7, wherein said second region at least partially surrounds said first region.

9. The capsule of claim 1, wherein said cluster comprises a non-permanent structure that is adapted to at least partially dissolve or break apart within said capsule when exposed to a flow of fluid over a period of time.

10. The capsule of claim 1, wherein said ingredients comprise roast ground coffee.

11. A capsule, for use in a machine that is adapted for injecting a fluid into a capsule for preparing a consumable product, said capsule comprising:

a body defining an interior space with an opening;

a filter disposed in said interior space to define an ingredients chamber;

an axis defined through said opening and said ingredients chamber in said body for receiving an injection of fluid from the machine insoluble ingredients disposed in said ingredients chamber for preparing a consumable product by extraction or infusion from the injection of fluid from the machine, a portion of said insoluble ingredients forming a control member that is disposed on the line of said axis, wherein said control member comprises a non-permanent structure that is adapted to at least partially dissolve or break apart within said capsule when exposed to the injection of fluid over a period of time; and a cover disposed over said opening.

12. The capsule of claim 11, wherein said control member comprises a cluster formed of compressed ingredients.

13. The capsule of claim 11, wherein said control member comprises a cluster that includes a binder material that is adapted to bind said portion of ingredients together.

14. The capsule of claim 13, wherein said ingredients are provided in a dry state and said binder material is provided in a liquid state.

15. The capsule of claim 11, wherein said control member comprises a soluble container that is adapted to contain said portion of ingredients.

16. The capsule of claim 11, wherein said control member is disposed in a first region within said ingredients chamber and at least a portion of the remainder of said ingredients is disposed in a second region within said ingredients chamber.

17. The capsule of claim 16, wherein said second region at least partially surrounds said first region.

18. The capsule of claim 11, wherein said ingredients comprise roast ground coffee.

19. The capsule of claim 1 wherein said cluster disperses the flow of fluid for a period of time.

20. The capsule of claim 1 wherein said cluster is also disposed along an axis that is transverse to said axis for receiving an injection of fluid from the machine.

21. The capsule of claim 1 wherein said cluster absorbs the flow of fluid for a period of time.

22. The capsule of claim 11 wherein said control member disperses the flow of fluid for a period of time.

23. The capsule of claim 11 wherein said control member absorbs the flow of fluid for a period of time.

* * * * *